US011198969B2

(12) United States Patent
Rozov

(10) Patent No.: US 11,198,969 B2
(45) Date of Patent: Dec. 14, 2021

(54) DOMESTIC COMPACT ARTICLE FOLDING MACHINE HAVING STACKED CONVEYOR LAYERS AND FOLDING METHOD THEREFOR

(71) Applicant: FOLDIMATE INC, Oak Park, CA (US)

(72) Inventor: Gal Rozov, Ma'abarot (IL)

(73) Assignee: FOLDIMATE, INC., Oak Park, CA (US)

( * ) Notice: Subject to any disclaimer, the term of this patent is extended or adjusted under 35 U.S.C. 154(b) by 5 days.

(21) Appl. No.: 16/349,167

(22) PCT Filed: Dec. 26, 2017

(86) PCT No.: PCT/IL2017/051387

§ 371 (c)(1),
(2) Date: May 10, 2019

(87) PCT Pub. No.: WO2018/122841

PCT Pub. Date: Jul. 5, 2018

(65) Prior Publication Data

US 2019/0309465 A1 Oct. 10, 2019

Related U.S. Application Data

(60) Provisional application No. 62/440,736, filed on Dec. 30, 2016.

(51) Int. Cl.
*D06F 89/02* (2006.01)
*A41H 43/02* (2006.01)

(52) U.S. Cl.
CPC ..... *D06F 89/02* (2013.01); *A41H 43/0257* (2013.01)

(58) Field of Classification Search
CPC ..... D06F 89/00; D06F 89/02; D06F 89/023; A41H 43/0257; A41H 43/025
USPC ..... 223/37
See application file for complete search history.

(56) References Cited

U.S. PATENT DOCUMENTS 1,968,233 A * 7/1934 Troy ..... D06F 67/06 38/67
3,190,640 A 6/1965 Sjostrom
3,361,424 A * 1/1968 Kamberg ..... D06F 89/00 493/423

(Continued)

FOREIGN PATENT DOCUMENTS

DE 4136214 A1 5/1993
DE 19504250 A1 10/1995

(Continued)

*Primary Examiner* — F Griffin Hall
(74) *Attorney, Agent, or Firm* — Blue Filament Law PLLC

(57) ABSTRACT

A domestic compact article folding machine (10) configured for autonomous article folding has machine top and bottom ends (12, 14) and a uniform machine body portion which extends therebetween. The folding machine (10) includes an active loading system (20) located at the machine top end (12), at least five stacked conveyor layers (38) and an active unloading system (22) located at the machine bottom end (14). Outer dimensions of the folding machine (10) are equal or smaller than a domestic appliance for article treatment. The folding machine (10) is configured to fold the article at least once in a width of the article and at least once in a length thereof.

15 Claims, 6 Drawing Sheets

(56) References Cited

U.S. PATENT DOCUMENTS

| | | | | |
|---|---|---|---|---|
| 5,435,802 | A * | 7/1995 | Kober | D06F 89/00 493/23 |
| 8,973,792 | B1 * | 3/2015 | Selker | D06F 89/023 223/37 |
| 2010/0007077 | A1 * | 1/2010 | Satake | B65H 1/12 271/111 |

FOREIGN PATENT DOCUMENTS

| | | | |
|---|---|---|---|
| GB | 1083101 | A | 9/1967 |
| GB | 1324202 | A | 7/1973 |
| JP | 2013252295 | A | 12/2013 |

* cited by examiner

DOMESTIC COMPACT ARTICLE FOLDING MACHINE HAVING STACKED CONVEYOR LAYERS AND FOLDING METHOD THEREFOR

FIELD OF THE INVENTION

The subject matter of the current application relates to garment/fabrics folding machines. Specifically, it relates to non-industrial, relatively compact and light folding machines configured only for domestic use. The current application does not relate to folding machines configured for folding large items such as bed sheets, or small items such as socks or underwear.

BACKGROUND OF THE INVENTION

There has been a long felt need in the domestic consumer market for a compact, affordable product which can quickly and reliably fold our laundry. Folding machines of the field are known and disclosed, for example, in U.S. Pat. No. 8,973,792.

SUMMARY OF THE INVENTION

In accordance with the subject matter of the present application there is provided a domestic compact article folding machine configured for autonomous article folding and having machine top and bottom ends and a uniform machine body extending therebetween, the folding machine comprising:

an active loading system located at the machine top end, at least five stacked conveyor layers; and an active unloading system located at the machine bottom end, wherein outer dimensions of the folding machine are equal or smaller than a domestic appliance for article treatment; and wherein the folding machine is configured to fold the article at least once in a width of the article and at least once in a length thereof.

Any of the following features, either alone or in combination, may be applicable to any of the above aspects of the subject matter of the application:

The machine body has exactly three conveyor layers and the loading and unloading systems each includes exactly one conveyor layer.

The machine body has exactly five conveyor layers and the loading and unloading systems each includes exactly one conveyor layer.

The folding machine can have a box-shaped enclosure which comprises machine top and bottom surfaces and a machine peripheral surface which extends therebetween; and in an operative mode, the loading system protrudes outwardly from the machine peripheral surface.

The loading system comprises an input hanger assembly which has an adjustable width portion and configured to match various article sizes.

The loading system is adjustable in a lateral direction and configured to accommodate and load various article sizes.

Each conveyor layer comprises only one or two conveyors.

The folding machine comprises at least one service door at one or both machine side surfaces and/or at one or both machine front and rear surfaces.

The folding machine is not configured to fold articles wider than 70 cm.

The folding machine is not configured to fold articles longer than 150 cm.

The folding machine is not configured to fold articles fabrics thicker than 15 millimeters.

The folding machine can have exactly seven stacked conveyor layers;

Each pair of adjacent layers can have at least 50 percent overlap therebetween.

The loading system is retractable, and folds inside the machine when not in use.

The loading system can comprise a motorized loading hanger assembly located within the folding machine when not in use and extendable outwardly therefrom in an operative mode.

The loading system can have an adjustable width.

The unloading system comprises a conveyor which moves back and forth in the longitudinal direction and configured for stacking articles by cooperating with a conveyor layer located adjacently thereabove.

The folding machine comprises sensors configured for detecting existence, width and/or thickness and/or length of articles.

The folding machine according to claim 1, wherein the folding machine comprises further article handling or treatment.

The folding machine comprises a fabric softening arrangement and/or a fragrance arrangement.

BRIEF DESCRIPTION OF THE DRAWINGS

For a better understanding of the subject matter of the present application and to show how the same may be carried out in practice, reference will now be made to the accompanying drawings, in which.

Figure 1:
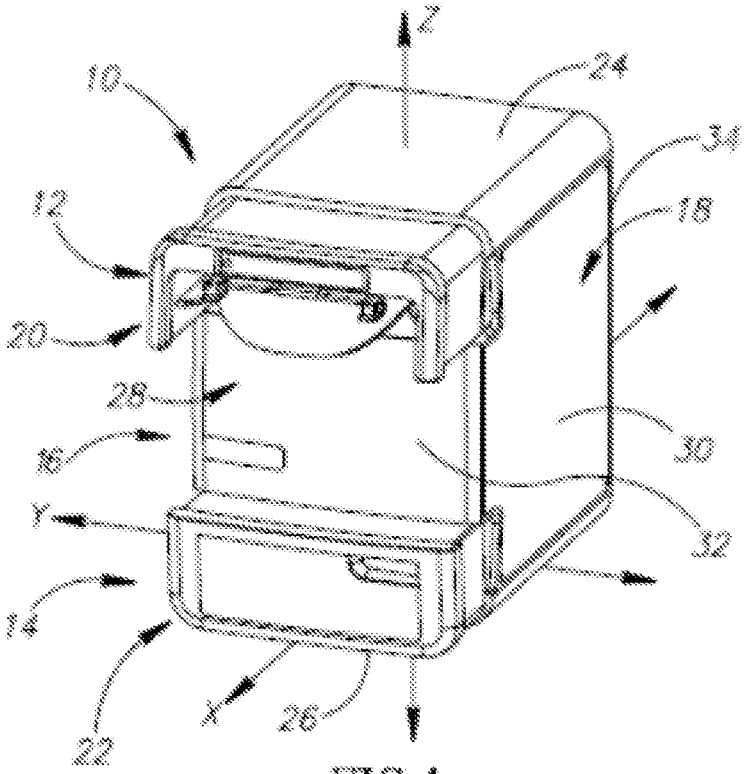
FIG. 1 is an isometric external view of a folding machine in an operative mode.

Where considered appropriate, reference numerals may be repeated among the figures to indicate corresponding or analogous elements.

DETAILED DESCRIPTION OF THE INVENTION

In the following description, various aspects of the subject matter of the present application will be described. For purposes of explanation, specific configurations and details are set forth in sufficient detail to provide a thorough understanding of the subject matter of the present application. However, it will also be apparent to one skilled in the art that the subject matter of the present application can be practiced without some specific configurations and details presented herein.

Figure 2:
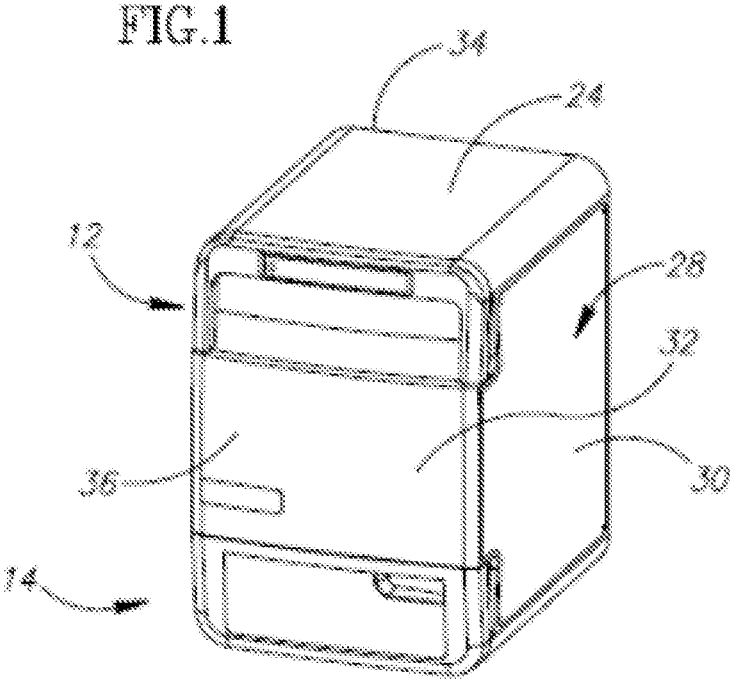
FIG. 2 is an isometric external view of a folding machine in a non-operative mode.
Figure 3:
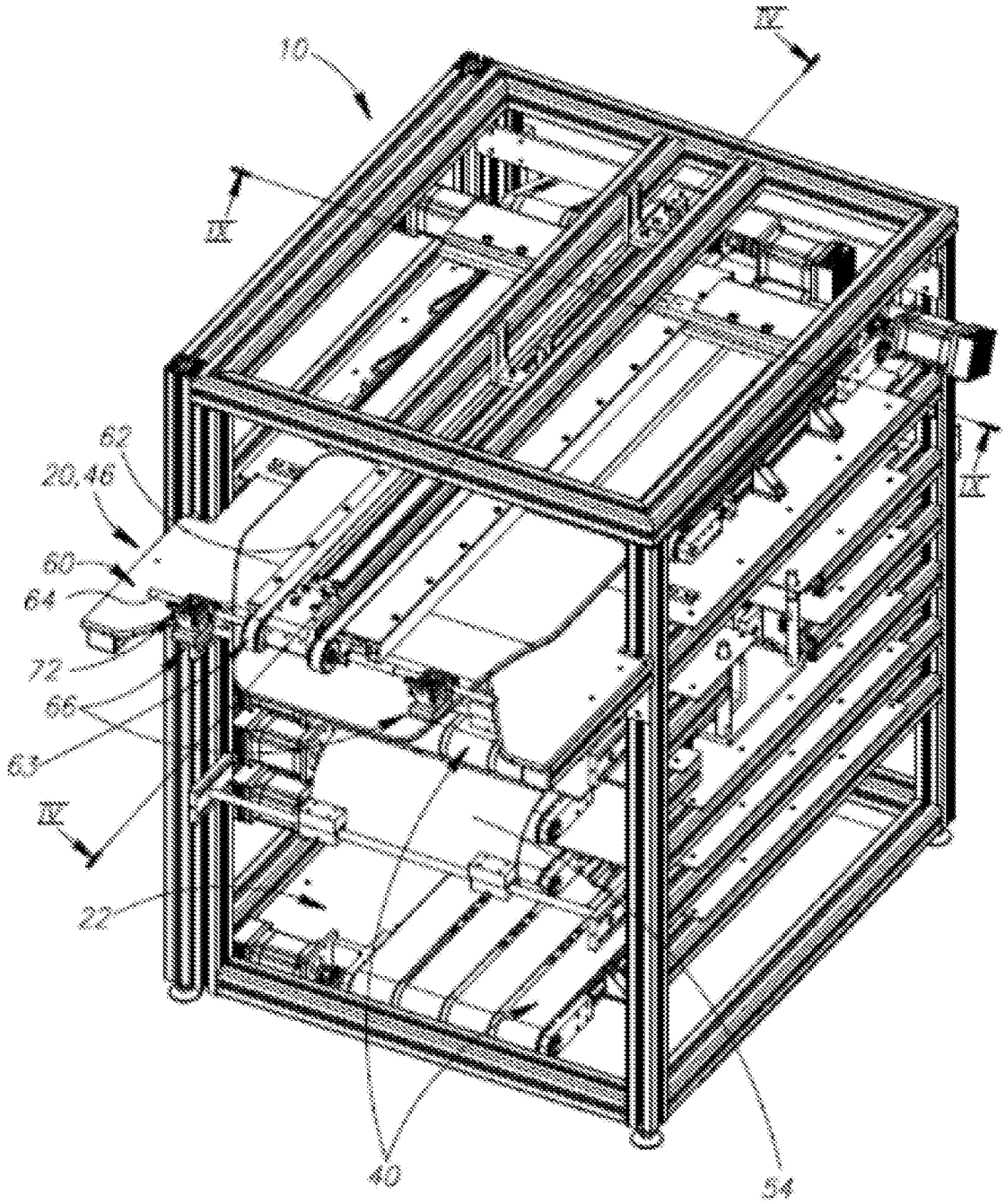
FIG. 3 is an isometric internal view of the folding machine of FIG. 1 with its enclosure removed.

Reference is made to FIGS. 1 and 2. A folding machine 10 has machine top and bottom ends 12, 14 and a uniform machine body 16 which extends therebetween. In a non-operative, or storage, mode all the sub-systems of the folding machine 10 are preferably located inside an enclosure 18. The enclosure 18 can be fabricated from recycled plastic or similar material to minimize weight and enable easy design and cheaper manufacturing. The machine top end 12 has a loading system 20 which protrudes outwardly therefrom and the machine bottom end 14 has an unloading system 22 which protrudes as well.

The enclosure 18 has machine top and bottom surfaces 24, 26 and a machine peripheral surface 28 which extends there between. The machine peripheral surface 28 can have opposite machine side surfaces 30 and opposite machine front and rear surfaces 32, 34 which extend between the machine side surfaces 30. The machine top and bottom end 12, 14 are located in the machine front surface 32. The enclosure 18 can include at least one service door 36.

The folding machine 10, and specifically the dimensions of the outer enclosure 18, are preferably smaller than 65 centimeters in width; smaller than 85 centimeters in height and smaller than 75 centimeters in depth. According to one embodiment, the folding machine can be smaller than 125 centimeters. One of the main goals according to the subject matter of the application is producing a household folding machine 10, the outer dimensions of which (in the non-operative mode) do not exceed the dimensions of standard domestic appliances for article treatment, e.g., washing machines or driers. Another goal and advantage of the current design strategy is not to exceed the weight of similar appliances, which enables easier and cheaper shipping, and indoor carrying and moving. According to the present example, the folding machine 10 weighs less than 35 kilograms, and preferably, less than 30 kilograms.

The machine bottom surface 26 can be planar and defines a vertical axis Z which is perpendicular thereto and extends from a center of the machine bottom surface 26 and passes through the machine top surface 24. Alternatively, a base virtual plane which passes through base points or legs of the machine can define the vertical axis Z. A longitudinal axis X extends perpendicular to the vertical axis Z, lays in the machine bottom surface 26 or the base virtual plane and passes through the machine front and rear surfaces 32, 34. The longitudinal axis X extends midway between the machine side surfaces 30. A lateral axis Y extends perpendicular to the longitudinal axis X and to the vertical axis Z and lays in the machine bottom surface 26. The vertical axis Z defines a vertical direction parallel thereto. The longitudinal axis X defines a longitudinal direction parallel thereto. The lateral axis Y defines a lateral direction parallel thereto.

According to a preferred embodiment, the folding machine 10 has seven stacked conveyor layers 38. The machine body 16 can include five conveyor layers 38 and the loading and unloading systems 20, 22 each includes only a single conveyor layer 38. The expression 'conveyor layer' is used to describe one or two conveyors 40 located in, or associated with, a single conveyor layer 38. A conveyor 40, according to the present example, includes at least one belt or bendable strip of material stretched in an endless loop around exactly two parallel identical rollers or cylindrical members. The conveyors 40, and specifically the belts, extend in the longitudinal direction, and the rollers, and respective roller rotation axes, extend in the lateral direction.

Figure 4:
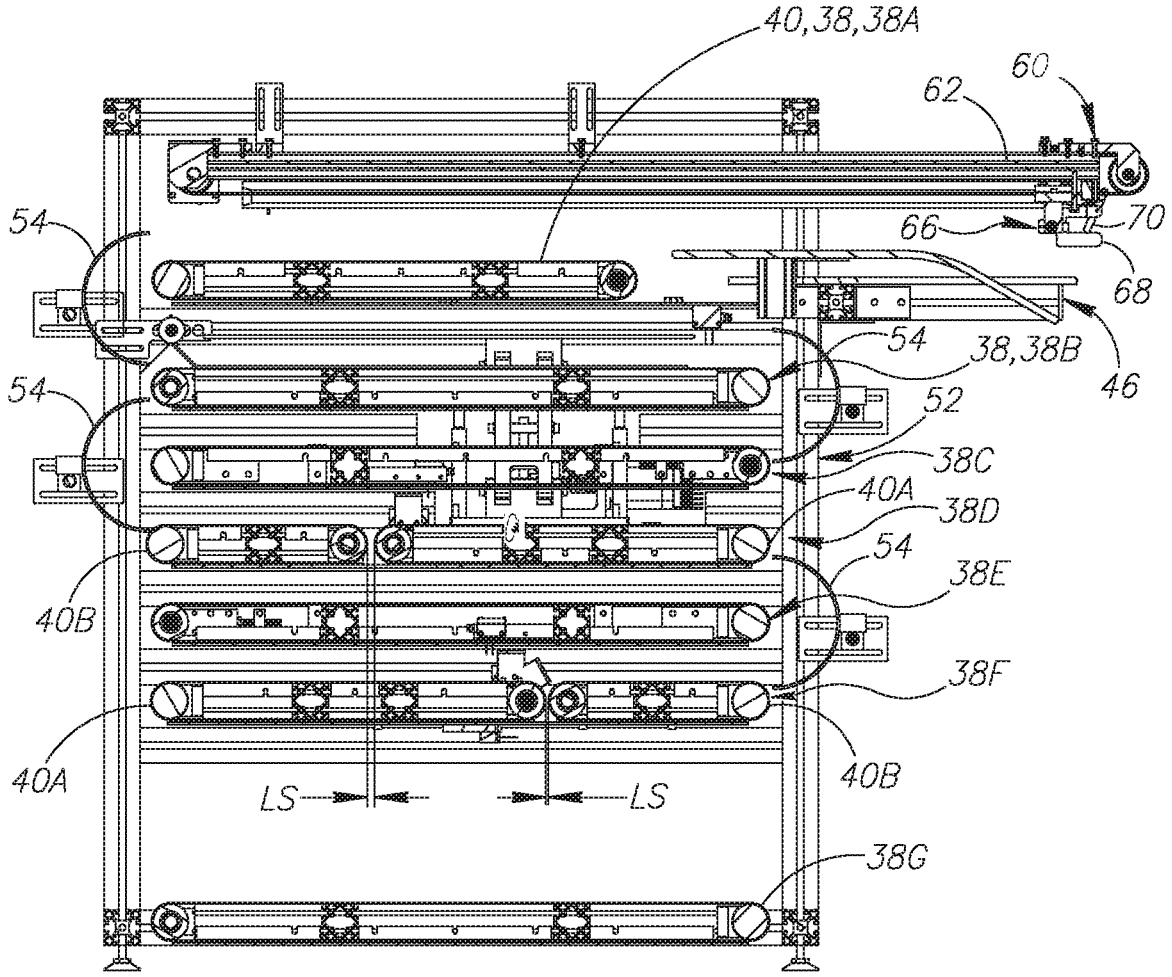
FIG. 4 is a cross-section taken along line IV-IV in FIG. 3.

The word stacked is used to describe a structure in which layers at least partially overlap in a top-to-bottom/plan view thereof (as seen in FIG. 4). In other words, each conveyor layer 38 is located either under, or above, an adjacent conveyor layer 38. In a preferred embodiment, the overlap spans across at least 50 percent of the conveyor layer 38. In a more preferred embodiment spans across at least 70 percent of the conveyor layer 38. According to the present example, two conveyors 40 of a given conveyor layer 38 can be co-planar. As will further be explained in detail below, the number of stacked conveyor layers 38, and the number of conveyors 40 per layer, directly affect the type and amount of folds the folding machine 10 is capable of performing The folding machine 10 can fold articles in the lateral direction and in the longitudinal direction. A fold in the lateral direction of the folding machine 10 will be referred to herein as a width fold. A fold in the longitudinal direction of the folding machine 10 will be referred to herein as a length fold. According to the current example, and as will be explained in detail below, the machine has a passive first width-folder 46 mechanism and an active second width-folder 48 mechanism. A conveyor layer 38 which includes two conveyors 40 with a space therebetween, can be considered a length-folder 50. According to the subject matter of the present application, a folding machine 10 with three conveyor layers 38 in the machine body 16 can perform a single length fold and a folding machine 10 with five conveyor layers 38 can perform one or two length folds, depending on the length of the article loaded into the folding machine 10. In the machine body 16, a conveyor layer 38 which has a single conveyor 40 and no other mechanisms, can be regarded as a reversing layer 52, configured only to flip, or turn the article 180 degrees, from a position in which one side of the article faces upwards towards the machine top surface 24 into a position where it faces towards the machine bottom surface 26, or vice versa. Where desired, the reversing layers 52 can also reverse articles in the longitudinal direction, or turn them 180 degrees about the vertical axis Z. The folding machine 10 can include reversing members 54 which are configured to enable the article to slide thereupon from one conveyor 40 to the next conveyor 40 located thereunder. The reversing members 54 also prevent the articles from falling from the conveyors 40. The reversing members 54 can have a cylindrical shape.

Figure 5:
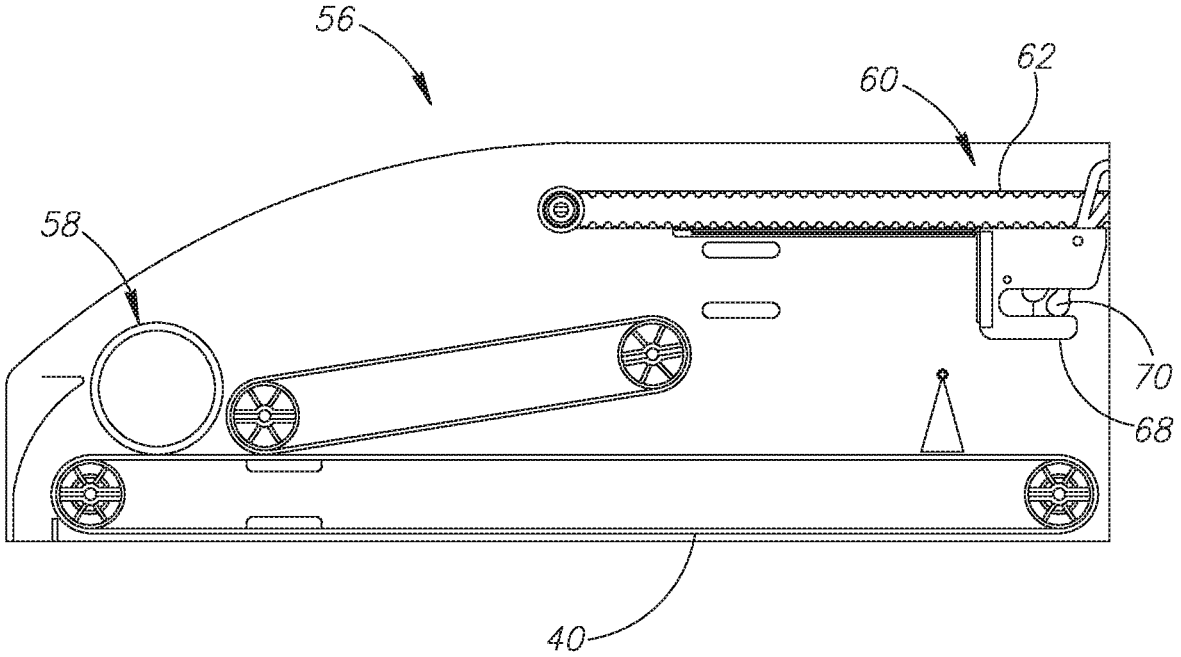
FIG. 5 is a detailed side view of a fabric de-wrinkling module located adjacent a loading system.
Figure 6:
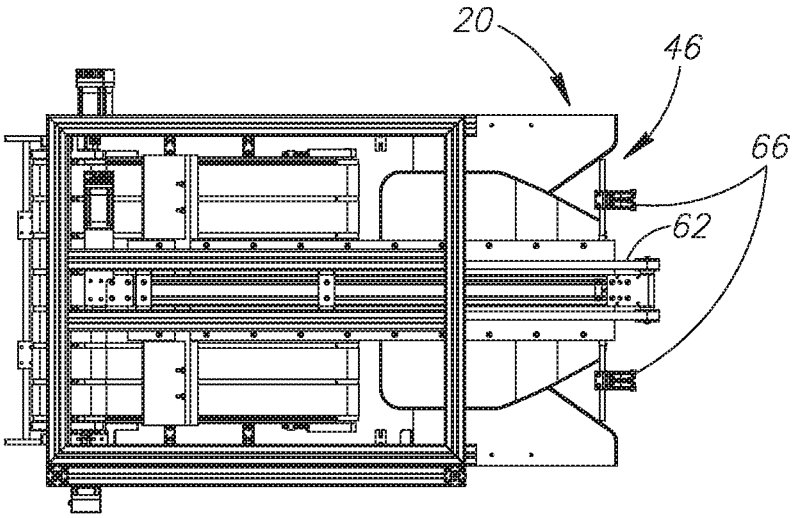
FIG. 6 is a top view of the folding machine of FIG. 3.
Figure 7:
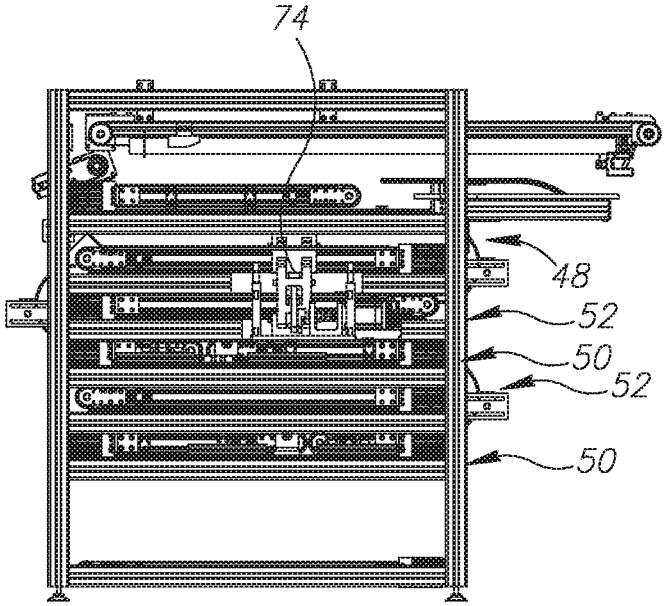
FIG. 7 is a side view of the folding machine of FIG. 3.
Figure 8:
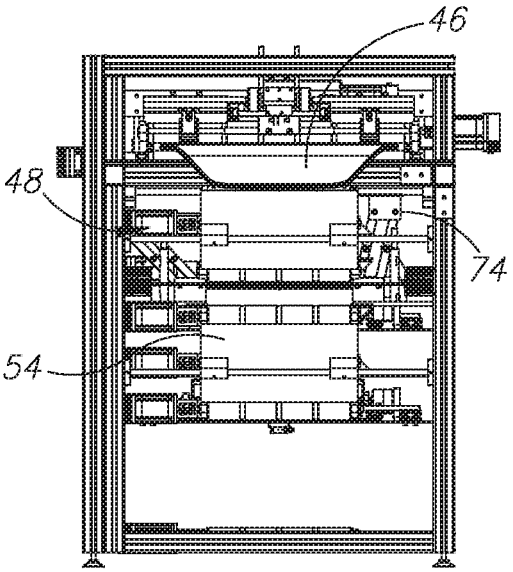
FIG. 8 is a front view of the folding machine of FIG. 3.
Figure 9:
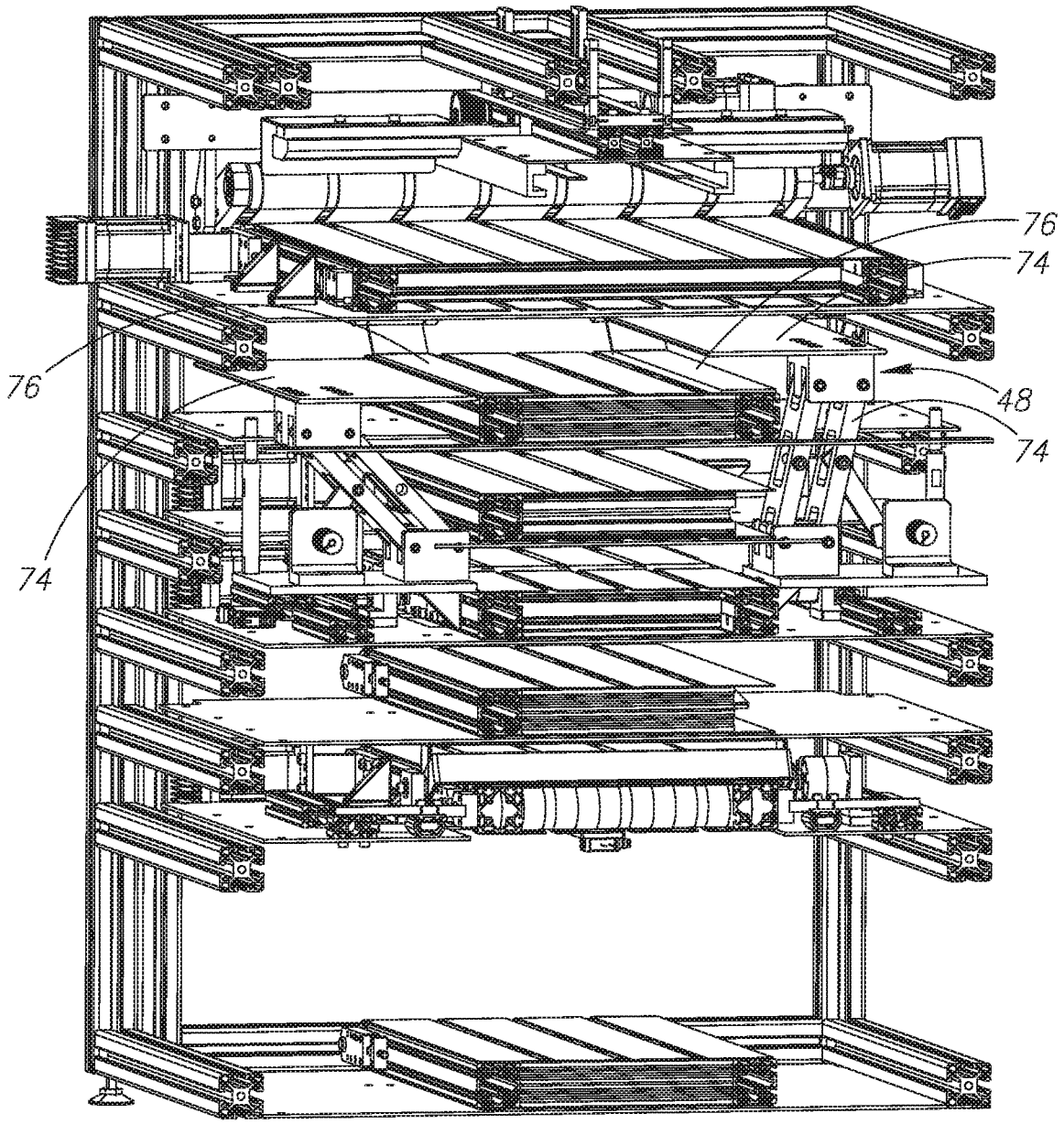
FIG. 9 is an isometric cross-sectional view taken along line IX-IX in FIG. 3.

Attention is drawn to FIG. 5. The folding machine 10 can also include an article treatment system 56, such e.g., a softening arrangement and/or a fragrance arrangement.

The term treatment can refer to spraying of chemicals (e.g., perfume). The treatment system 56 can include sanitize/sterilization agent, softener, etc. The treatment system 56 is preferably located midway between the machine top and bottom ends 12, 14 and preferably adjacent the machine bottom end 14 (machine body 16 or unloading system 22). According to some embodiments, the folding machine 10 can include a latterly extending pipe which includes spraying nozzles (perpendicular to the longitudinal direction).

Another type of treatment system 56 can include a De-wrinkling process which can include spraying softener followed by pressing the fabric against the conveyor 40 with a heated roller 58 as depicted in FIG. 5. The De-wrinkling treatment is preferably located at the beginning of the article folding process, i.e., at the loading system 20.

According to the present embodiment, the folding machine 10 has exactly two width-folders 46, 48, exactly two length-folders 50 and two reversing layers 52.

The loading system 20 is preferably at least partially retractable, i.e., it can be drawn in, or fold inside the enclosure 18 when not in use i.e., in the non-operative mode. In the operative mode, the loading system 20 extends, or the majority of which, is located outwardly, or externally to the folding machine 10, or to the machine front surface 32 of the enclosure 18. This is advantageous, since the articles are easier to "hand over" to the folding machine 10 by an operator, or user, of the folding machine when the loading system 20 extends outwardly from the machine, being more accessible to the user. While retractability is not a requirement in an operative mode, protruding outwardly is. This structure is not advantageous only in terms of user ergonomics, but also because the article requires a minimal travel while being hung in the vertical direction before entering the loading system 20, or specifically, the static or passive first width-folder 46. The loading system 20 can include a single hanger assembly 60 and a single conveyor layer 38 which includes a single conveyor 40. The loading system 20 further includes the first width folding mechanism, or the first width-folder 46, which is located farthest from the folding machine rear surface 34 at a loading system front end.

Attention is drawn to FIG. 4. The first width-folder 46 is configured to fold excess fabric at sides of the article, such as sleeves. The first width-folder 46 is a passive mechanism, in the sense that it does not move the fabric to fold it, but rather the fabric is folded simply by being pulled thereacross. According to the present embodiment, the first width-folder 46 includes a female member and a corresponding male member which is located thereabove. The female member is plate-shaped and includes a trapezoidal opening with two first folding edges which converge in the longitudinal direction and inwards, towards the machine rear surface 34. The female member can be planar. The male member is also plate-shaped, and can include a trapezoidal protrusion with two second folding edges which converge in the longitudinal direction, outwardly away from the machine rear surface 34. The male member includes a bend such that the protrusion is oriented transversely to the opening and passes therethrough. The second folding edges are located between the first folding edges (transversely thereto) such that when an article pulled across the male member (towards the machine rear surface 34) climbs onto the protrusion and any excess fabric at its sides is urged, or folded, by the first folding edges in a direction towards a plane defined by the longitudinal and vertical axes X, Z beneath the male member. Therefore, the excess fabric is already folded in the lateral direction (at its width) by the loading system 20. In a further preferred embodiment, the first width-folder 46 can automatically adjust its width, to accommodate different article widths. This can be achieved by female and male members, each of which divided into two portions which, using a rail mechanism can move in the lateral direction towards and from each other.

According to the present example, the hanger assembly 60 includes a hanger rail 62 which extends in the longitudinal direction and a chain 63, onto which a single hanger 64 is attached. The hanger 64 extends in the lateral direction and can include two clips 66 configured for releasably clamping the fabric. According to the present example, each clip 66 includes a static jaw 68 and a resilient clamping arm 70 which elastically folds (or lifts) inwards when the fabric is inserted into the clip 66, and elastically clamps the fabric onto the static jaw 68 such that when the hanger assembly 60 is moved, it carries the article with it. According to some embodiments, it is impossible to remove the fabric without lifting the clamping arm 70 or damaging the fabric. At an inwardly located release portion, the hanger rail 62 can include a release arm 72 which forces and lifts the clamping arms 70 enabling a release of the fabric at a desired location onto the conveyor 40 thereunder.

The loading system 20 conveyor layer 38 is located under the hanger rail 62 and slightly below the first width-folder 46. The first width-folder 46 is located further outwardly than the loading system 20 conveyor layer 38 in the operative mode.

In a conveyor layer 38 which includes two adjacent conveyors 40 and performs a length fold (referred to herein as a length-folder 50), a layer space LS is defined between the two conveyors 40 in the longitudinal direction. The layer space LS location in the longitudinal direction is preferably closer to a reversing member 54 which conveys the article onto the same layer, than the vertical axis Z. The layer space LS can range between 3*mm* and 40*mm*. The length fold is performed while the two conveyors 40A, 40B rotate in opposite directions, towards each other (i.e., always a top half of each conveyor band), pulling, or forcing (via friction) the article through the layer space LS which is configured to self-adjust, thereby allowing the article to flow therethrough. In this way, the article simply has nowhere else to proceed, other than through the layer space LS. It is noted that a fold apex is determined at a specific location in the article which was located above the layer space LS before the conveyors 40A, 40B began to rotate towards each other.

In a length-folder 50, a first conveyor 40A is static, or fixed, and a second conveyor 40B is mounted on a rail which enables movement back and forth in the longitudinal direction. The layer space LS is adjustable depending on the thickness of article being folded. In the current embodiment, this adjustment is achieved by a spring which forces the second conveyor 40B towards the first conveyor 40A. However, this can be achieved by a motor which moves the second conveyor 40B.

According to embodiments of the present application, the folding machine 10 can also include a folding member which is located above the layer space LS and forces/pushes the fabric therethrough, until enough friction is generated such that the article is pulled through the layer space LS solely by the simultaneous roll/rotation of the conveyors 40A, 40B. This can improve reliability in some examples where the fabric generates less-than-desired friction force with the conveyors 40A, 40B.

The second width-folder 48 can include motorized mechanical folding arms 74 which are located opposite of each other in the lateral direction, on both sides of the second conveyor layer 38B and configured to lift and width-fold the article. The second-width folder 48 can include ski-shaped panels 76 which are configured to hold the fabric, press it against the conveyor to allow the folding arms 74 to fold only the necessary portion of the fabric, and locate, or set the location of, the folding line. The folding arms 74 can be synchronized, thereby folding one after the other to prevent fabrics hitting each other. Another advantage stemming from two arms alternatingly working in the same space is to save valuable space in the lateral direction. In other words, the folding arms 74 can have an overlapping relationship without engagement. The folding arms 74 can work in the lateral direction while at the same time the article is being conveyed in the longitudinal direction.

According to one embodiment, the folding machine 10 can fold articles with a preferred range of fabric thickness between 0.5 millimeters and 12 millimeters. This range may vary depending on user preference and/or application (i.e., fabric types).

The folding machine 10 includes sensors across the folding path inside the folding machine 10. According to the present example, electro-optic, or specifically, photo-electric sensors are used to detect the existence of articles and to measure lengths thereof.

A designated surplus space is defined between the conveyors and the enclosure 18 in the vertical direction, which enables the folding machine 10 to accommodate and handle long, or longer articles which, e.g., are longer than a length of a conveyor layer 38.

According to the present embodiment, and as shown in FIG. 1, the unloading system 22 is also retractable, and includes a tray, and preferably also a basket. A relatively large basket space is defined between the lowest conveyor layer 38 of the machine body 16 and the conveyor layer 38 of the unloading system 22 to accommodate the basket, in which the folded articles are collected. In the vertical direction, the basket space can receive values in the range of between 18 centimeters and 25. The basket rests on the conveyor of the unloading system 22 and is configured to move therewith. In other words, a large friction force, or a clamping arrangement (e.g., protrusion and corresponding recesses) exists between the basket and the conveyor which prevents relative movement. In other embodiments, in an alternate solution to the conveyor, the basket can be moved back and forth in the longitudinal direction by rollers or similar arrangement capable of performing the same.

According to a preferred embodiment, the loading system 20 has a first conveyor layer 38A, the machine body 16 has a second, third, fourth fifth and sixth conveyor layers 38B-38F and the unloading system 22 has a seventh conveyor layer 38G. A method of folding articles can include the following steps:

a. Using the hanger assembly 60 to pull an article over the passive first width-folder 46 while performing a first width fold thereabout.
b. Conveying the article using the first conveyor layer 38A to the second conveyor layer 38B.
c. Performing a second width fold using the active second width-folder 48.
d. Reversing the article by conveying it to the third conveyor layer 38C and further conveying the article to the fourth conveyor layer 38D,
e. If required by a desired folding method, or from determining required length, performing a first length fold by conveying the article through the layer space LS between the two adjacent conveyors of the fourth conveyor layer 38D and onto the fifth conveyor layer 38E which rotates, or rolls, in sync with the fourth conveyor layer 38D to prevent unfolding of the article.
f. Reversing the article with the fifth conveyor layer 38E by conveying the article to the sixth conveyor layer 38F.
g. If required by a desired folding method, or from determining required length, performing a second length fold by conveying the article through the layer space LS between the two adjacent conveyors of the sixth conveyor layer 38F and onto the seventh conveyor layer 38G which rotates, or rolls, in sync with the sixth conveyor layer 38F to prevent unfolding of the article.

In a preferred embodiment, the folding machine 10 can accommodate up to four articles simultaneously, and consecutively, while folding, or in an operative mode. For example, one article can be located on the gripper/clips 66 before the first conveyor layer 38A, a second article can be located on the second and/or first conveyor layers 38B, 38A, a third article can be located on the fourth and/or 3rd conveyor layers and a fourth article can be located on the sixth and/or fifth conveyor layers 38F, 38E (the folded articles are stacked in the basket).

The invention claimed is:

1. A domestic compact article folding machine configured for autonomous article folding and having machine top and bottom ends and a uniform machine body extending therebetween, the folding machine comprising:

an active loading system consisting of a first single conveyor layer and located at the machine top end on a front side;

at least five stacked conveyor layers, wherein each pair of adjacent layers have at least 70 percent overlap therebetween and are parallel to one another; and an active unloading system consisting of a second single conveyor layer and located at the machine bottom end on the front side, characterized in that, the folding machine is configured to fold the article at least once in a width of the article and at least once in a length of the article;

the folding machine is a box-shaped enclosure with a machine peripheral surface that in an operative mode, the loading system and the unloading system protrude outwardly from the machine peripheral surface located on the front side.

2. The folding machine according to claim 1, wherein the machine body has exactly five conveyor layers and the loading and unloading systems each include exactly one conveyor layer.

3. The folding machine according to claim 1, wherein the loading system comprises an active hanger assembly which has an adjustable width portion and configured to match various article sizes.

4. The folding machine according to claim 1, wherein the loading system is adjustable in a lateral direction and configured to accommodate and load various article sizes.

5. The folding machine according to claim 1, wherein the folding machine comprises at least one service door at one or both machine side surfaces and/or at one or both machine front and rear surfaces.

6. The folding machine according to claim 1, wherein the folding machine is not configured to fold articles wider than 70 cm or longer than 150 cm or thicker than 15 mm.

7. The folding machine according claim 1, wherein each pair of adjacent layers have at least 90 percent overlap therebetween.

8. The folding machine according to claim 1, wherein the loading system is retractable, and folds inside the machine when not in use.

9. The folding machine according to claim 1, wherein the loading system comprises a motorized loading active hanger assembly located within the folding machine when not in use and extendable outwardly therefrom in an operative mode.

10. The folding machine according to claim 1, wherein the loading system has an adjustable width.

11. The folding machine according to claim 1, wherein the unloading system comprises a conveyor which moves back and forth in the longitudinal direction and configured for stacking articles by cooperating with a conveyor layer of the at least five stacked conveyor layers located adjacently thereabove.

12. The folding machine according to claim 1, wherein the folding machine comprises sensors configured for detecting existence, width and/or thickness and/or length of articles.

13. The folding machine according to claim 1, wherein bed sheets are not supported.

14. The folding machine according to claim 1, wherein the folding machine comprises an article treatment system (56).

15. The folding machine according to claim 1, wherein the folding machine comprises a heated roller (58) configured to press the article against a conveyor.

* * * * *